US009175414B2

(12) United States Patent
Hoshino et al.

(10) Patent No.: US 9,175,414 B2
(45) Date of Patent: Nov. 3, 2015

(54) COLD ROLLED STEEL SHEET

(75) Inventors: Katsuya Hoshino, Chiyoda-ku (JP); Shinji Ootsuka, Chiyoda-ku (JP); Takayoshi Yano, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/825,443

(22) PCT Filed: Sep. 28, 2011

(86) PCT No.: PCT/JP2011/072153

§ 371 (c)(1),
(2), (4) Date: Jun. 7, 2013

(87) PCT Pub. No.: WO2012/043610

PCT Pub. Date: Apr. 5, 2012

(65) Prior Publication Data

US 2013/0260141 A1 Oct. 3, 2013

(30) Foreign Application Priority Data

Sep. 29, 2010 (JP) ..... 2010-217991

(51) Int. Cl.
*C25D 9/10* (2006.01)

(52) U.S. Cl.
CPC ..... *C25D 9/10* (2013.01); *Y10T 428/265* (2015.01)

(58) Field of Classification Search
None
See application file for complete search history.

(56) References Cited

U.S. PATENT DOCUMENTS

| | | | | |
|---|---|---|---|---|
| 6,589,603 | B1 | 7/2003 | Cornell | |
| 6,837,925 | B2 | 1/2005 | Kubo | |
| 7,238,288 | B1 | 7/2007 | Gao | |
| 2006/0194008 | A1 | 8/2006 | Schwartz | |
| 2007/0213445 | A1* | 9/2007 | Klijn et al. | 524/445 |
| 2008/0021115 | A1 | 1/2008 | Ikematsu | |
| 2009/0032144 | A1 | 2/2009 | McMillen | |
| 2011/0076488 | A1 | 3/2011 | Lee | |
| 2012/0082845 | A1* | 4/2012 | Makimizu et al. | 428/336 |
| 2012/0321908 | A1* | 12/2012 | Hoshino et al. | 428/626 |
| 2013/0260141 | A1 | 10/2013 | Hoshino | |
| 2014/0147663 | A1* | 5/2014 | Hoshino et al. | 428/336 |

FOREIGN PATENT DOCUMENTS

| | | | |
|---|---|---|---|
| CN | 1906254 | | 1/2007 |
| CN | 101720344 | | 6/2010 |
| EP | 1749866 | | 2/2007 |
| EP | 1840113 | | 10/2007 |
| EP | 2505351 | | 10/2012 |
| JP | 5360332 | | 5/1978 |
| JP | 54112731 | | 9/1979 |
| JP | 598354 | | 1/1984 |
| JP | 2190483 | | 7/1990 |
| JP | 3191093 | | 8/1991 |
| JP | 444840 | | 2/1992 |
| JP | 4088196 | | 3/1992 |
| JP | 07-180064 | A | 7/1995 |
| JP | 1025596 | | 1/1998 |
| JP | 11151778 | | 6/1999 |
| JP | 11158436 | | 6/1999 |
| JP | 2001-234119 | | 8/2001 |
| JP | 2002-307613 | | 10/2002 |
| JP | 2005178213 | | 7/2005 |
| JP | 2005298694 | | 10/2005 |
| JP | 2006-274385 | A | 10/2006 |
| JP | 200739549 | | 2/2007 |
| JP | 2007-275706 | | 10/2007 |
| JP | 2008055732 | | 3/2008 |
| JP | 2008081808 | | 4/2008 |
| JP | 2009516017 | | 4/2009 |
| JP | 201059513 | | 3/2010 |
| JP | 2011131586 | | 7/2011 |
| KR | 20090119403 | | 11/2009 |
| WO | WO 02068329 | A1 * | 9/2002 |
| WO | 2005071023 | | 8/2005 |
| WO | WO 2009031699 | A1 * | 3/2009 |
| WO | 2009139590 | | 11/2009 |

OTHER PUBLICATIONS

JP2010059513_MT Mar. 18, 2010.*
International Search Report for International Application No. PCT/JP2011/072153 dated Nov. 22, 2011.
International Search Report for Interational Application No. PCT/JP2011/071956 dated Dec. 27, 2011.
Supplementary European Search Report dated Jun. 18 2014, application No. EP 11 82 9064.
Entire patent prosecution history of U.S. Appl. No. 13/824,772, filed, May 30, 2013, entitled, "Cold Rolled Steel Sheet."
Sharma et al., "Eco-friendly synthesis of jasminaldehyde by condensation of 1-heptanal with benzaldehyde using hydrotalcite as a solid case catalyst," Journal of Molecular Catalyst A: Chemical 286, 2008, 55-62.
Office Action mailed Dec. 5, 2014, U.S. Appl. No. 13/824,772.
Entire patent prosecution history of U.S. Appl. No. 13/511,229, filed, Sep. 5, 2012, entitled, "Galvanized Steel Sheet."
Korean Office Action mailed Nov. 17, 2014 for Korean Application No. 10-2013-7007587.
B.R. Venugopal, Layered Double Hydroxide—CdSe Quantum Dot Composites through Colloidal Processing, J. Phy. Chem: American Chemical Society, 2006, 100, pp. 772-776.
Canadian Office Action mailed Apr. 9, 2015 for Canadian Office Action 2,813,070.

(Continued)

*Primary Examiner* — Vera Katz
(74) *Attorney, Agent, or Firm* — RatnerPrestia

(57) ABSTRACT

In order to obtain a cold rolled steel sheet having excellent press formability, a cold rolled steel sheet has an inorganic film containing a crystalline layered material having an average film thickness of 10 nm to 2000 nm on a surface thereof. The crystalline layered material preferably is, for example, a layered double hydroxide represented by $[M^{2+}{}_{1-X}M^{3+}{}_{X}(OH)_2][A^{n-}]_{x/n}.zH_2O$, where: $M^{2+}$ is one or more of $Mg^{2+}$, $Ca^{2+}$, $Fe^{2+}$, $Ni^{2+}$, and $Zn^{2+}$; $M^{3+}$ is one or more of $Al^{3+}$, $Fe^{3+}$, and $Cr^{3+}$; and $A^{n-}$ is one or more of $OH^-$, $CO_3{}^{2-}$, $Cl^-$, and $(SO_4)^{2-}$.

2 Claims, 2 Drawing Sheets

(56) References Cited

OTHER PUBLICATIONS

Chinese Office Action mailed Nov. 17, 2014 in Chinese Application No. 201180046632.6.

Final Office Action mailed Apr. 13, 2015 in U.S. Appl. No. 13/824,772.

Japanese Office Action mailed Jul. 15, 2014 for Japanese Application No. 2010-217991.

Japanese Office Action mailed Mar. 31, 2015 for Japanese Application No. 2010-217991.

Korean Office Action mailed Apr. 8, 2014 for Korean Application No. 10-2013-7005828.

Korean Office Action mailed Nov. 18, 2014 in Korean Application No. 10-2013-7005828.

Korean Office Action for Korean Application No. 2013-7005828 dated May 21, 2015.

Chinese Office Action for Application No. 2011800466326 dated Jun. 30, 2015.

Non-Final Office Action for U.S. Appl. No. 13/824,772 dated Sep. 4, 2015.

* cited by examiner

COLD ROLLED STEEL SHEET

CROSS REFERENCE TO RELATED APPLICATIONS

This application is the U.S. National Phase application of PCT International Application No. PCT/JP2011/072153, filed Sep. 28, 2011, and claims priority to Japanese Patent Application No. 2010-217991, filed Sep. 29, 2010, the disclosures of both applications being incorporated herein by reference in their entireties for all purposes.

FIELD OF THE INVENTION

The present invention relates to a cold rolled steel sheet having excellent press formability.

BACKGROUND OF THE INVENTION

Cold rolled steel sheets are widely used in various fields with a focus on uses in automotive bodies. For such uses, they are subjected to press-forming to be made available for use. In particular, from a viewpoint of recent strengthening of $CO_2$ emission regulations, usage ratios of high-strength steel sheets tend to increase with the aim to reduce weights of automotive bodies. However, of cold rolled steel sheets, for those having a base material with a strength exceeding 440 MPa, the higher the strength of the base material, the higher the contact pressure during press forming becomes and the more the hardness of the cold rolled steel sheet approaches the hardness of a mold, and thus, there is a problem in that scratches called mold galling are likely to occur, which are formed by a cold rolled steel sheet being galled by a mold. More specifically, during continuous press forming, molds are severely worn down, and this adversely affects productivity of automobiles, by ruining the appearance of molded articles, for example.

As a method for suppressing the occurrence of mold galling in cold rolled steel sheets, a surface treatment on molds is widely used. In this method, however, adjustment of molds cannot be performed after a surface treatment. Further, this method has another problem of high cost. Therefore, there is a strong demand for cold rolled steel sheets harder to cause mold galling (with improved mold galling resistance).

A large number of techniques have been reported for forming lubricating films on the surfaces of cold rolled steel sheets. Patent Literature 1 describes a technique for forming on a steel sheet a lubricating film containing: an alkali metal borate; and, as a lubricant, a mixture of zinc stearate and a wax.

Patent Literature 2 describes a technique for forming on a steel sheet a lithium silicate as a film component with a wax and a metallic soap, which are added thereto as lubricants.

Patent Literature 3 describes a lubricant-coated steel sheet in which a polyurethane resin having a silanol group or a hydroxy group is formed with a thickness of 1 to 15 μm, and which has excellent continuous formability in high contact-pressure forming.

PATENT LITERATURE

Patent Literature 1: Japanese Patent Application Laid-open No. 2007-275706

Patent Literature 2: Japanese Patent Application Laid-open No. 2002-307613

Patent Literature 3: Japanese Patent Application Laid-open No. 2001-234119

SUMMARY OF THE INVENTION

Although in Patent Literature 1 to 3, lubricity is achieved by the lubricants or the like contained, required characteristics are not fully satisfied particularly in parts under high contact-pressure like high-strength cold rolled steel sheets.

The present invention provides a cold rolled steel sheet having excellent press formability, by which mold galling is hard to occur and elaborate press forming is possible, for difficult-to-form materials such as a high-strength steel sheet on which the contact pressure increases during press forming.

Much of the lubricity of lubricating films depends on the lubricating performance of a lubricant in the film, and it is considered that development of a novel lubricant is required. The inventors of the present invention have thus diligently performed studies to invent a technique that utilizes deformation caused by an interlayer slip of a crystalline layered material as a lubricating mechanism. If the interlayer slip occurs by a low stress, resistance when the slip occurs is expected to be small even under a high pressure (contact pressure) and excellent lubricity is expected to be achieved. To discover specific crystalline layered materials, substances in which layers are bonded by a weak bonding strength such as an intermolecular force, hydrogen bonding, and electrostatic energy, were extracted. It has been found that by applying predetermined amounts of inorganic films containing those extracted crystalline layered materials on surfaces of cold rolled steel sheets, slidability is dramatically improved (sliding resistance is reduced). Further, it has been found that as the crystalline layered material a layered double hydroxide in which divalent and trivalent metal hydroxides are bonded with anions by electrostatic energy is suitable.

The present invention has been made based on the foregoing findings, and a summary of embodiments of the invention is provided below.

[1] A cold rolled steel sheet having an inorganic film containing a crystalline layered material on a surface thereof, wherein the inorganic film has an average film thickness of 10 nm to 2000 nm.

[2] The cold-rolled steel sheet characterized in that in [1] above, the crystalline layered material is a layered double hydroxide represented by $[M^{2+}_{1-x}M^{3+}_{x}(OH)_2][A^{n-}]_{x/n}.zH_2O$, wherein: $M^{2+}$ is one or more of $Mg^{2+}$, $Ca^{2+}$, $Fe^{2+}$, $Ni^{2+}$, $Zn^{2+}$, $Pb^{2+}$, and $Sn^{2+}$; $M^{3+}$ is one or more of $Al^{3+}$, $Fe^{3+}$, $Cr^{3+}$, ¾$Zr^{4+}$, and $Mo^{3+}$; and $A^{n-}$ is one or more of $OH^-$, $F^-$, $CO_3^{2-}$, $Cl^-$, $Br^-$, $(C_2O_4)^{2-}$, $I^-$, $(NO_3)^-$, $(SO_4)^{2-}$, $(BrO_3)^-$, $(IO_3)^-$, $(V_{10}O_{28})^{6-}$, $(Si_2O_5)^{2-}$, $(ClO_4)^-$, $(CH_3COO)^-$, $[C_6H_4(CO_2)_2]^{2-}$, $(C_6H_5COO)^-$, $[C_8H_{16}(CO_2)_2]^{2-}$, $n(C_8H_{17}SO_4)^-$, TPPC, $n(C_{12}H_{25}SO_4)^-$, $n(C_{18}H_{37}SO_4)^-$, and $SiO_4^{4-}$.

[3] The cold-rolled steel sheet characterized in that in [1] above, the crystalline layered material is a layered double hydroxide represented by $[M^{2+}_{1-x}M^{3+}_{x}(OH)_2][A^{n-}]_{x/n}.zH_2O$, wherein: $M^{2+}$ is one or more of $Mg^{2+}$, $Ca^{2+}$, $Fe^{2+}$, $Ni^{2+}$, and $Zn^{2+}$; $M^{3+}$ is one or more of $Al^{3+}$, $Fe^{3+}$, and $Cr^{3+}$; and $A^{n-}$ is one or more of $OH^-$, $CO_3^{2-}$, $Cl^-$, and $(SO_4)^{2-}$.

According to the present invention, even for a high-strength cold rolled steel sheet in which a contact pressure increases during press forming, a cold rolled steel sheet is provided, which has a small sliding resistance in a part at which mold galling tends to occur and has excellent mold galling resistance. Further, a cold rolled steel sheet is obtained, which has excellent press formability in that mold galling is hard to occur and elaborate press forming is possible even in a part at which contact pressure is high and plating adhesion to the mold is supposed.

DESCRIPTION OF EMBODIMENTS OF THE INVENTION

Figure 1:
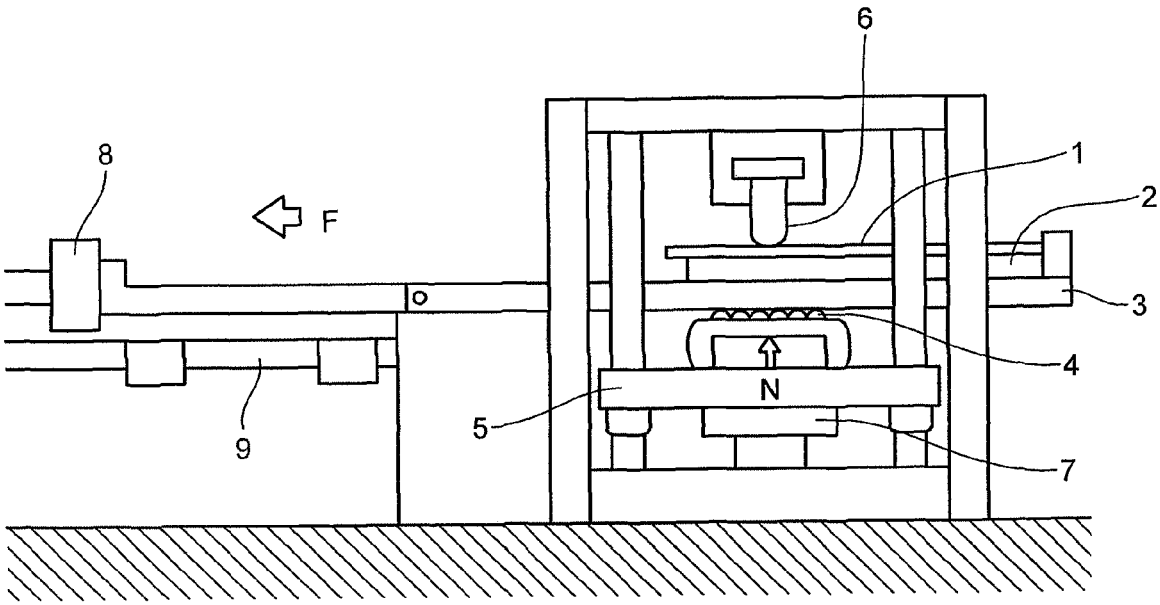
FIG. 1 is a schematic front view of a friction coefficient measuring apparatus.

A cold rolled steel sheet of an embodiment of the present invention has an inorganic film containing a crystalline layered material on a surface of the cold rolled steel sheet, and the inorganic film has an average film thickness of 10 nm to 2000 nm. These are the most important aspects of the cold rolled steel sheet of the present invention.

By applying a predetermined amount of the inorganic film containing the crystalline layered material on the surface of the cold rolled steel sheet, slidability is improved dramatically. A mechanism of lubrication of the crystalline layered material contained in the inorganic film may be understood as follows. When a mold and a cold rolled steel sheet slide, a shear stress is generated on a surface of the cold rolled steel sheet due to an adhesive force between the surfaces of the mold and the cold rolled steel sheet. The presence of a crystalline layered material between the cold rolled steel sheet and the mold causes deformation of the crystalline layered material due to interlayer slips and absorbance of a shear deformation stress generated on the surfaces. Even after the cold rolled steel sheet is worn down and the crystalline layered material is scraped off from the surface of the cold rolled steel sheet, the crystalline layered material adheres to the mold and exhibits an effect of reducing the friction resistance between the mold and the cold rolled steel sheet, and thus even under a high contact-pressure condition supposing a high-strength steel sheet, the effect is achieved sufficiently.

The thickness of the inorganic film containing the crystalline layered material is, as a thickness when observed from a cross section with a SEM, 10 nm or more and 2000 nm or less in average film thickness. When the average film thickness is less than 10 nm, it is hard to obtain the effect of improving the slidability sufficiently. When the average film thickness exceeds 2000 nm, there is a concern that spot weldability that is important in automobile manufacture may decrease. The thickness of the inorganic film is measured from a result of observing an FIB-processed cross section with an ultra-low acceleration SEM. Identification of a crystal structure about whether the crystalline layered material is crystalline may be performed by thin-film X-ray diffraction.

Further, in an embodiment of the present invention, the crystalline layered material is, from among unit crystal lattices, a crystal in which plate-shaped covalent bond crystals are layered over one another with relatively weak bonding such as an intermolecular force, hydrogen bonding, and electrostatic energy. A layered double hydroxide having a structure representable by $[M^{2+}{}_{1-X}M^{3+}{}_{X}(OH)_2][A^{n-}]_{x/n}.zH_2O$, in particular, has a layered crystal structure, since anions that are negatively charged are bonded with positively charged plate-shaped divalent and trivalent metal hydroxides by electrostatic energy in order to keep electric balance and has stacked layers, and is preferably used as the crystalline layered material of the present invention. Being the layered double hydroxide indicated by $[M^{2+}{}_{1-X}M^{3+}{}_{X}(OH)_2][A^{n-}]_{x/n}.zH_2O$ is known to be identifiable by X-ray diffraction and a substance representable by the formula is known to be a layered crystal. The crystalline material representable by $[M^{2+}{}_{1-X}M^{3+}{}_{X}(OH)_2][A^{n-}]_{x/n}.zH_2O$ becomes layered because negatively charged anions are bonded with positively charged plate-shaped divalent and trivalent metal hydroxides by electrostatic energy in order to keep electric balance and these are stacked in layers.

The $M^{2+}$ is preferably one or more of $Mg^{2+}$, $Ca^{2+}$, $Fe^{2+}$, $Ni^{2+}$, $Zn^{2+}$, $Pb^{2+}$, and $Sn^{2+}$. In particular, $Mg^{2+}$, $Ca^{2+}$, $Fe^{2+}$, $Ni^{2+}$, and $Zn^{2+}$ are more preferable because they have been identified as layered double hydroxide species that are produced naturally or artificially and they are able to exist as layered double hydroxides stably.

The $M^{3+}$ is preferably one or more of $Al^{3+}$, $Fe^{3+}$, $Cr^{3+}$, ¾$Zr^{4+}$, and $Mo^{3+}$. In particular, $Al^{3+}$, $Fe^{3+}$, and $Cr^{3+}$ are more preferable because they have been identified as layered double hydroxide species that are produced naturally or artificially and they are able to exist as layered double hydroxides stably.

The $A^{n-}$ is preferably one or more of $OH^-$, $CO_3{}^{2-}$, $Cl^-$, $Br^-$, $(C_2O_4)^{2-}$, $(NO_3)^-$, $(SO_4)^{2-}$, $(BrO_3)^-$, $(IO_3)^-$, $(V_{10}O_{28})^{6-}$, $(Si_2O_5)^{2-}$, $(ClO_4)^-$, $(CH_3COO)^-$, $[C_6H_4(CO_2)_2]^{2-}$, $(C_6H_5COO)^-$, $[C_8H_{16}(CO_2)_2]^{2-}$, $n(C_8H_{17}SO_4)^-$, TPPC, $n(C_{12}H_{28}SO_4)^-$, $n(C_{18}H_{37}SO_4)^-$, and $SiO_4{}^{4-}$. They have been confirmed to be incorporated as interlayer anions of layered double hydroxides, and they are able to exist as layered double hydroxides. In particular, $OH^-$, $CO_3{}^{2-}$, $Cl^-$, and $(SO_4)^{2-}$ may be used as the anions more preferably because they are easier to be incorporated as the interlayer anions than other anions of layered double hydroxide species upon film formation on a surface of a cold rolled steels sheet, and the film formation is possible in a short period of time.

Next, a method of producing the crystalline layered material on the surface of a cold rolled steel sheet will be explained. A method using an electrochemical reaction will be described as an example of a method of producing a layered double hydroxide, which is one type of the crystalline layered material, on the surface of a cold rolled steel sheet. An electric current of 0.01 to 100 A/dm$^2$ is flowed in an acidic solution having a pH of 0.5 to 7.0 and containing any one or more of divalent cations ($M^{2+}$), any one or more of trivalent cations ($M^{3+}$), and any one or more anions of $A^{n-}$=(inorganic inions or organic anions) with the cold rolled steel sheet being a cathode.

Although a mechanism by which the crystalline layered material is produced is not clear, it may be understood as follows. When an electric current is flowed with the cold rolled steel sheet being a cathode, reduction of hydrogen ions or a decomposition reaction of dissolved oxygen occurs on the cold rolled steel sheet side, and the pH of the surface of the cold rolled steel sheet increases. The divalent cations and trivalent cations present in the acidic solution are produced in colloidal form as hydroxides in a region where the pH has increased on the surface of the cold rolled steel sheet. If any one or more of particular anions of $OH^-$, $F^-$, $CO_3{}^{2-}$, $Cl^-$, $Br^-$, $(C_2O_4)^{2-}$, $I^-$, $(NO_3)^-$, $(SO_4)^{2-}$, $(BrO_3)^-$, $(IO_3)^-$, $(V_{10}O_{28})^{6-}$, $(Si_2O_5)^{2-}$, $(ClO_4)^-$, $(CH_3COO)^-$, $[C_6H_4(CO_2)_2]^{2-}$, $(C_6H_5COO)^-$, $[C_8H_{16}(CO_2)_2]^{2-}$, $n(C_8H_{17}SO_4)^-$, TPPC, $n(C_{12}H_{25}SO_4)^-$, $n(C_{18}H_{37}SO_4)^-$, and $SiO_4{}^{4-}$ are present in the solution, the metal hydroxides precipitate as a layered double hydroxide on the surface of the cold rolled steel sheet. Whether the obtained powdery substance is a layered compound may be confirmed by X-ray diffraction. Even if N, Pb, Na, Mn, Ba, Sr, Si, or the like is incorporated into the inorganic film containing the crystalline layered material produced, by inclusion of impurities in the treatment liquid used in film forming treatment or the like, the effect of the present invention is not impaired.

Example 1

The present invention will be explained in further detail with reference to examples. A cold rolled steel sheet having a plate thickness of 0.7 mm was subjected to temper rolling. Subsequently, as a process of producing the layered double hydroxide, the cold rolled steel sheet was immersed in a solution containing 113 g/L of magnesium nitrate hexahydrate, 83 g/L of aluminum nitrate nonahydrate, and 31 g/L of sodium carbonate decahydrate and having the pH adjusted to 5.0 with nitric acid, and electricity was conducted with a current density of 1 A/dm$^2$ with the cold rolled steel sheet being a cathode for 2 to 300 seconds. Next, after sufficient washing with water was performed, drying was performed.

An average film thickness of the film (inorganic film) containing the layered double hydroxide on the surface of the cold rolled steel sheet obtained as described above was measured, and the layered double hydroxide was identified. As a method of evaluating press formability indicating ease of elaborate press forming, measurement of kinetic friction coefficients and evaluation of mold galling resistances were conducted. A method of measuring the average film thickness of the layered double hydroxide produced on the surface of the cold rolled steel sheet, a method of identifying the layered double hydroxide, a method of measuring the kinetic friction coefficient, and a method of measuring the mold galling resistance are as follows.

(1) Method of Measuring the Average Film Thickness of the Layered Double Hydroxide Film (Inorganic Film)

A cross section of the organic film was sputtered at 45 degrees using an FIB, arbitrary ten points were extracted from a result of observing from the cross section with an ultra-low acceleration SEM and measured, and an average value thereof was regarded as the average film thickness of the inorganic film.

(2) Method of Identifying the Layered Double Hydroxide

The presence of a crystalline layered double hydroxide was confirmed by a thin film X-ray diffraction method. Peaks obtained by the thin film method using a Cu—Kα radiation with an incident angle of 0.5° were compared with ICDD cards to identify the layered double hydroxide. The matched cards were as follows:

Magnesium Aluminum Hydroxide Carbonate Hydrate

ICDD card reference code: 01-089-0460

$[Mg_{0.667}Al_{0.333}(OH)_2][CO_3^{2-}]_{0.167}0.5H_2O$ (3) Method of Measuring the Kinetic Friction Coefficient To evaluate the press formability (in particular, the press formability in drawing and inflow portions) the kinetic friction coefficient of each sample was measured as follows. FIG. 1 is a schematic front view illustrating a friction coefficient measuring apparatus. As illustrated in the figure, a kinetic friction coefficient measuring specimen 1 taken from a sample is fixed to a specimen stand 2, and the specimen stand 2 is fixed to an upper surface of a slide table 3, which is horizontally movable. On a lower surface of the slide table 3, a slide table support 5, which has rollers 4 contacting the lower surface and is vertically movable, is provided, and a first load cell 7 for measuring a pressing load N to the kinetic friction coefficient measuring specimen 1 from a bead 6 by pushing up the slide table support 5 is attached to the slide table support 5. To measure a sliding resistance force N for moving the slide table 3 horizontally with the above-described pressing force being acted, a second load cell 8 is attached to one end of the slide table 3. As a lubricating oil, the PRETON R352L manufactured by Sugimura Chemical Industrial Co., Ltd. was applied on the surface of the kinetic friction coefficient measuring specimen 1 to conduct tests.

Figure 2:
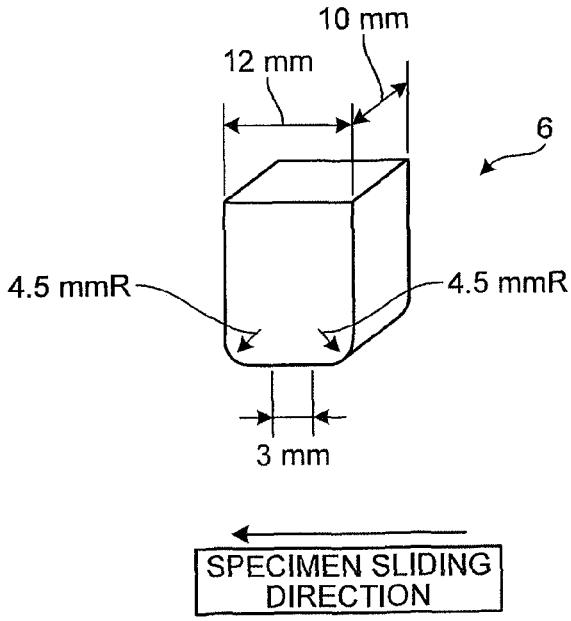
FIG. 2 is a schematic perspective view illustrating a first shape and dimensions of a bead 6 in FIG. 1.

FIG. 2 is a schematic perspective view illustrating a first shape and dimensions of the bead 6 used (hereinafter, bead shape 1). It is slid with a bottom surface of the bead 6 pressed against the surface of the kinetic friction coefficient measuring specimen 1. The shape of the bead 6 illustrated in FIG. 2 is formed of: a width of 10 mm; a length in a specimen sliding direction of 12 mm; and curved surfaces with a curvature of 4.5 mm; at portions of both ends in the sliding direction, and the bead's bottom surface, against which the specimen is pressed, has a plane with a width of 10 mm and a length in the sliding direction of 3 mm.

Figure 3:
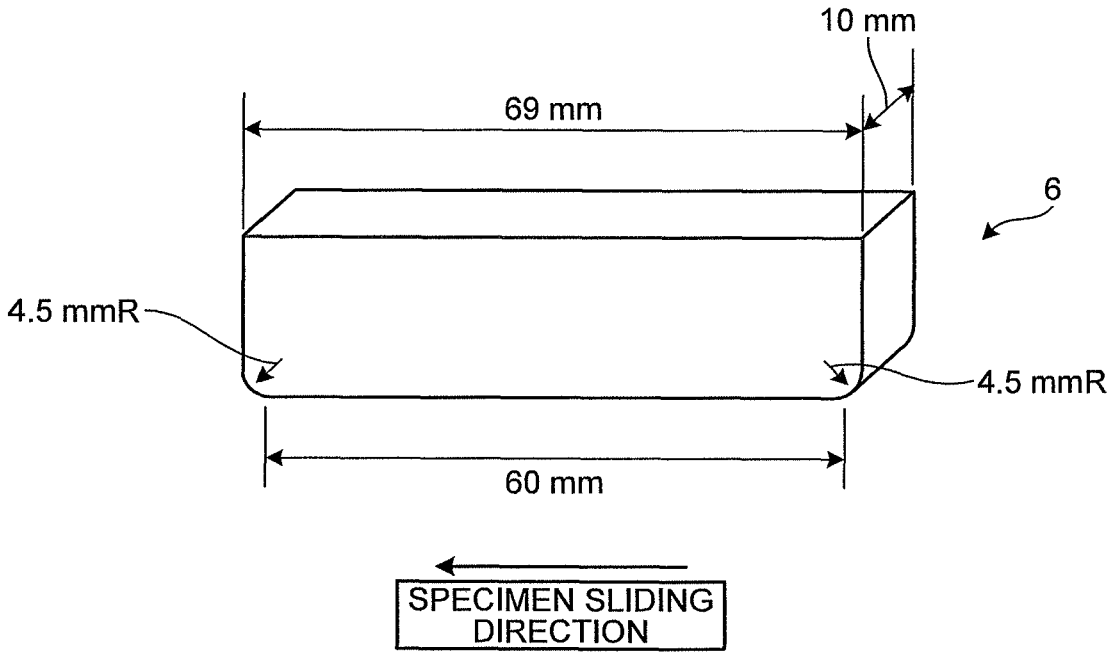
FIG. 3 is a schematic perspective view illustrating a second shape and dimensions of the bead 6 in FIG. 1.

FIG. 3 is a schematic perspective view illustrating a second shape and dimensions of the bead 6 used (hereinafter, bead shape 2). It is slid with a bottom surface of the bead 6 pressed against the surface of the kinetic friction coefficient measuring specimen 1. The shape of the bead 6 illustrated in FIG. 3 is formed of: a width of 10 mm; a length in the specimen sliding direction of 69 mm; and curved surfaces with a curvature of 4.5 mm; at lower portions of both ends in the sliding direction, and the bead's bottom surface against which the specimen is pressed has a plane with a width of 10 mm and a length in the sliding direction of 60 mm.

The measurement of kinetic friction coefficients was conducted under three conditions in which the pressing loads N were 400, 1200, and 1600 kgf at room temperature (25° C.) so that contact pressures supposing press forming of a high-strength steel sheet are exerted. The specimens' drawing speed (a horizontal moving speed of the slide table 3) was 100 cm/min or 20 cm/min. Under these conditions, the pressing load N and the sliding resistance force F were measured, and the kinetic friction coefficient μ between the sample and the bead 6 was calculated by the equation: $\mu=F/N$.

Combinations of the bead shape, pressing load, and drawing speed are as follows:

Condition 1: Bead shape 1, a pressing load of 400 kgf, and a drawing speed of 100 cm/min Condition 2: Bead shape 1, a pressing load of 1200 kgf, and a drawing speed of 100 cm/min Condition 3 Bead shape 1, a pressing load of 1600 kgf, and a drawing speed of 100 cm/min Condition 4: Bead shape 2, a pressing load of 400 kgf, and a drawing speed of 20 cm/min Method of Measuring Mold Galling Resistance In addition to the kinetic friction coefficient, in cold rolled steel sheets, mold galling is likely to occur because a cold rolled steel sheet and a mold adhere to each other in portions having a long sliding distance and the sliding resistance increases. Using the friction coefficient measuring apparatus illustrated in FIG. 1, therefore, sliding tests were repeated 50 times, and mold galling resistance was evaluated, with a count of how many repeated times the kinetic friction coefficient increased by 0.01 or more being regarded as a repeat count of mold galling occurrences. If no increase in the kinetic friction coefficient was recognized even after the sliding tests were repeated 50 times, the repeat count was regarded as 50 times or more. The test were conducted, like the above-described (3) method of measuring the kinetic friction coefficient, under the above-described conditions 1 to 3 so that a contact pressure supposing press forming of a high-strength steel sheet was realized.

The test results thus obtained are listed in Table 1 with the conditions.

TABLE 1

| No. | Plating type | Solution used | Electric conduction time (sec) | Film thickness (nm) | Composition of layered double hydroxide (Identification results) |
|---|---|---|---|---|---|
| 1 | Cold rolled steel sheet | No treatment | none | none | — |
| 2 | | Magnesium nitrate hexahydrate: 113 g/L | 2 | 2 nm | ICDD card reference code: 01-089-0460 |
| 3 | | Aluminum nitrate nonahydrate: 83 g/L | 8 | 10 nm | $[Mg_{0.667}Al_{0.333}(OH)_2][CO_3^{2-}]_{0.167}\cdot 0.5H_2O$ Magnesium Aluminum Hydroxide |
| 4 | | Sodium carbonate decahydrate: 31 g/L | 30 | 50 nm | Carbonate Hydrate |
| 5 | | | 60 | 100 nm | |
| 6 | | | 300 | 500 nm | |

| No. | Kinetic friction coefficient | | | | Mold galling resistance | | | Notes |
|---|---|---|---|---|---|---|---|---|
| | Condition 1 | Condition 2 | Condition 3 | Condition 4 | Condition 1 | Condition 2 | Condition 3 | |
| 1 | 0.137 | 0.113 | —*4 | 0.171 | 50 or more | 5 | 0 | Comparative Example |
| 2 | 0.119 | 0.095 | 0.075 | 0.162 | 7 | 4 | 3 | Comparative Example |
| 3 | 0.104 | 0.074 | 0.067 | 0.135 | 15 | 10 | 8 | Inventive Example |
| 4 | 0.098 | 0.072 | 0.065 | 0.132 | 34 | 21 | 16 | Inventive Example |
| 5 | 0.092 | 0.069 | 0.063 | 0.119 | 50 or more | 34 | 26 | Inventive Example |
| 6 | 0.085 | 0.064 | 0.060 | 0.110 | 50 or more | 42 | 32 | Inventive Example |

*4Immeasurable due to occurrence of mold galling

The following has become clear from the test results listed in Table 1. No. 1 is a cold rolled steel sheet not subjected to a film forming treatment and a comparative example with respect to the present invention. All of its kinetic friction coefficients are of high values. No. 1 is an example in which no crystalline layered material is adhered to the surface of the cold rolled steel sheet and a comparative example with respect to the present invention. Its kinetic friction coefficients are high, and the mold galling resistances are inferior. No. 2 have the crystalline layered material applied on the surface of the cold rolled steel sheet, but its average film thickness is out of the scope of the present invention and it is another comparative example with respect to the present invention. Its kinetic friction coefficients are lower than those of No. 1, and although the mold galling resistances are improved, it cannot be said to be sufficient. Nos. 3 to 6 have the crystalline layered material applied on the surface of the cold rolled steel sheet, their average film thicknesses are within the scope of the present invention, and they are examples of the present invention. The inventive examples, Nos. 3 to 6, have lower kinetic friction coefficients and better mold galling resistances as compared with the comparative examples, Nos. 1 and 2.

Example 2

A cold rolled steel sheet having a plate thickness of 0.7 mm was subjected to temper rolling. Subsequently, as a process of forming a layered double hydroxide, the cold rolled steel sheet was immersed in a solution containing the composition listed in Table 2 and having a pH adjusted to 5.0 using nitric acid, and electricity was conducted with a current density of 1 A/dm$^2$ with the cold rolled steel sheet being a cathode for 2 to 300 seconds. Next, this cold rolled steel sheet was sufficiently washed with water and thereafter dried.

For the cold rolled steel sheet obtained as described above, the average film thickness of the layered double hydroxide film (inorganic film) on the surface thereof was measured, and the layered double hydroxide was identified. As a method of evaluating press formability, measurement of kinetic friction coefficients and evaluation of mold galling resistances were conducted. A method of measuring the average film thickness of the layered double hydroxide on the surface of the cold rolled steel sheet, a method of identifying the layered double hydroxides, a method of measuring the kinetic friction coefficient, and a method of measuring a mold galling resistance are the same as those in Example 1. The matched ICDD cards were as follows.

(a) Zinc Aluminum Carbonate Hydroxide Hydrate
ICDD card reference code: 00-048-1021 $[Zn_{0.71}Al_{0.29}(OH)_2][CO_3^{2-}]_{0.145}.H_2O$ (b) Iron Carbonate Hydroxide Hydrate
ICDD card reference code: 00-050-1380
$[Fe_{0.67}Fe_{0.33}(OH)_2][CO_3^{2-}]_{0.145}.0.33H_2O$ (c) Iron Nickel Sulfate Hydroxide Hydrate
ICDD card reference code: 00-042-0573
$[Ni_{0.75}Fe_{0.25}(OH)_2][SO_4^{2-}]_{0.125}.0.5H_2O$ (d) Magnesium Aluminum Hydroxide Hydrate
ICDD card reference code: 00-038-0478
$[Mg_{0.75}Al_{0.25}(OH)_2][OH^-]_{0.25}.0.5H_2O$ (e) Magnesium Iron Oxide Chloride Hydroxide Hydrate
ICDD card reference code: 00-020-0500
$[Mg_{0.75}Fe_{0.25}(OH)_2][Cl^-]_{0.25}.0.5H_2O$ (f) Calcium Aluminum Hydroxide Chloride Hydrate
ICDD card reference code: 00-035-0105
$[Ca_{0.67}Al_{0.33}(OH)_2][Cl^-]_{0.33}.0.67H_2O$ (g) Magnesium Chromium Carbonate Hydroxide Hydrate
ICDD card reference code: 00-045-1475
$[Mg_{0.67}Cr_{0.33}(OH)_2][CO_3^{2-}]_{0.157}.0.5H_2O$ (h) Iron Aluminum Oxide Carbonate Hydroxide Hydrate
ICDD card reference code: 00-051-1527
$[Fe_{0.67}Al_{0.33}(OH)_2][CO_3^{2-}]_{0.157}.0.5H_2O$ (i) Nickel Aluminum Oxide Carbonate Hydroxide Hydrate
ICDD card reference code: 00-015-0087
$[Ni_{0.67}Al_{0.33}(OH)_2][CO_3^{2-},OH^-]_{0.157}.0.5H_2O$ The test results obtained as described above are listed in Table 2 with the conditions.

TABLE 2

| No. | Plating type | Solution used | Electric conduction time (sec) | Film thickness (nm) | Composition of layered double hydroxide (Identification results) |
|---|---|---|---|---|---|
| 7 | Cold rolled steel sheet | No treatment | none | 0.0 | |
| 8 | | Zinc nitrate | 2 | 2 nm | ICDD card reference code: |
| 9 | | heptahydrate: 131 g/L | 8 | 10 nm | 00-048-1021 |
| 10 | | Aluminum nitrate | 30 | 50 nm | $[Zn_{0.71}Al_{0.29}(OH)_2][CO_3^{2-}]_{0.145}\bullet H_2O$ |
| 11 | | nonahydrate: 83 g/L | 60 | 100 nm | Zinc Aluminum Carbonate |
| | | Sodium carbonate | | | Hydroxide Hydrate |
| 12 | | decahydrate: 31 g/L | 300 | 500 nm | |
| 13 | | Iron(II) sulfate | 2 | 2 nm | ICDD card |
| 14 | | heptahydrate: 122 g/L | 8 | 10 nm | reference code: |
| 15 | | Iron(III) nitrate | 30 | 50 nm | 00-050-1380 |
| 16 | | nonahydrate: 89 g/L | 60 | 100 nm | $[Fe_{0.67}Fe_{0.33}(OH)_2][CO_3^{2-}]_{0.145}\bullet 0.33H_2O$ |
| | | Sodium carbonate | | | Iron Carbonate |
| 17 | | decahydrate: 31 g/L | 300 | 500 nm | Hydroxide Hydrate |
| 18 | | Nickel nitrate | 2 | 2 nm | ICDD card reference code: |
| 19 | | hexahydrate: 128 g/L | 8 | 10 nm | 00-042-0573 |
| 20 | | Iron(III) nitrate | 30 | 50 nm | $[Ni_{0.75}Fe_{0.25(OH)2}][SO_4^{2-}]_{0.125}\bullet 0.5H_2O$ |
| 21 | | nonahydrate: 89 g/L | 60 | 100 nm | Iron Nickel Sulfate Hydroxide |
| | | Sodium sulfate | | | Hydrate |
| 22 | | decahydrate: 31 g/L | 300 | 500 nm | |
| 23 | | Magnesium nitrate | 2 | 2 nm | ICDD card reference code: |
| 24 | | hexahydrate: 113 g/L | 8 | 10 nm | 00-038-0478 |
| 25 | | Aluminum nitrate | 30 | 50 nm | $[Mg_{0.75}Al_{0.25(OH)2}][OH^-]_{0.25}\bullet 0.5H_2O$ |
| 26 | | nonahydrate: 83 g/L | 60 | 100 nm | Magnesium Aluminum Hydroxide |
| | | | | | Hydrate |
| 27 | | | 300 | 500 nm | |
| 28 | | Magnesium nitrate | 2 | 2 nm | ICDD card reference code: |
| 29 | | hexahydrate: | 8 | 10 nm | 00-020-0500 |
| 30 | | 113 g/L | 30 | 50 nm | $[Mg_{0.75}Fe_{0.25}(OH)_2][Cl^-]_{0.25}\bullet 0.5H_2O$ |
| 31 | | Iron(III) nitrate: | 60 | 100 nm | Magnesium Iron Oxide Chloride |
| | | nonahydrate | | | Hydroxide Hydrate |
| 32 | | 89 g/L | 300 | 500 nm | |
| | | Sodium chloride: 6 g/L | | | |
| 33 | | Calcium nitrate | 2 | 2 nm | ICDD card reference code: |
| 34 | | tetrahydrate: 104 g/L | 8 | 10 nm | 00-035-0105 |
| 35 | | Aluminum nitrate | 30 | 50 nm | $[Ca_{0.67}Al_{0.33}(OH)_2][Cl^-]_{0.33}\bullet 0.67H_2O$ |
| 36 | | nonahydrate: 83 g/L | 60 | 100 nm | Calcium Aluminum Hydroxide |
| | | Sodium chloride: 6 g/L | | | Chloride Hydrate |
| 37 | | | 300 | 500 nm | |
| 38 | | Magnesium nitrate | 2 | 2 nm | ICDD card reference code: |
| 39 | | hexahydrate: 113 g/L | 8 | 10 nm | 00-045-1475 |
| 40 | | Chromium(III) | 30 | 50 nm | $[Mg_{0.67}Cr_{0.33}(OH)_2][CO_2^{2-}]_{0.157}\bullet 0.5H_2O$ |
| 41 | | nitrate nonahydrate: | 60 | 100 nm | Magnesium Chromium Carbonate |
| | | 88 g/L | | | Hydroxide Hydrate |
| 42 | | Sodium carbonate | 300 | 500 nm | |
| | | decahydrate: 31 g/L | | | |
| 43 | | Iron(II) sulfate | 2 | 2 nm | ICDD card reference code: |
| 44 | | heptahydrate: 122 g/L | 8 | 10 nm | 00-051-1527 |
| 45 | | Aluminum nitrate | 30 | 50 nm | $[Fe_{0.67}Al_{0.33}(OH)_2][CO_3^{2-}]_{0.157}\bullet 0.5H_2O$ |
| 46 | | nonahydrate: 83 g/L | 60 | 100 nm | Iron Aluminum Oxide Carbonate |
| | | Sodium carbonate | | | Hydroxide Hydrate |
| 47 | | decahydrate: 31 g/L | 300 | 500 nm | |
| 48 | | Nickel nitrate | 2 | 2 nm | ICDD card reference code: |
| 49 | | hexahydrate: 128 g/L | 8 | 10 nm | 00-015-0087 |
| 50 | | Aluminum nitrate | 30 | 50 nm | $[Ni_{0.67}Al_{0.33}(OH)_2][CO_3^{2-},OH^-]_{0.157}\bullet 0.5H_2O$ |
| 51 | | nonahydrate: 83 g/L | 60 | 100 nm | Nickel Aluminum Oxide Carbonate |
| | | Sodium carbonate | | | Hydroxide Hydrate |
| 52 | | decahydrate: 31 g/L | 300 | 500 nm | |

| | Kinetic friction coefficient | | | | Mold galling resistance | | | |
|---|---|---|---|---|---|---|---|---|
| No. | Condition 1 | Condition 2 | Condition 3 | Condition 4 | Condition 1 | Condition 2 | Condition 3 | Notes |
| 7 | 0.137 | 0.113 | —*1 | 0.171 | 50 or more | 5 | 0 | Comparative Example |

TABLE 2-continued

| | | | | | | | | |
|---|---|---|---|---|---|---|---|---|
| 8 | 0.121 | 0.093 | 0.075 | 0.159 | 6 | 3 | 3 | Comparative Example |
| 9 | 0.105 | 0.075 | 0.068 | 0.135 | 20 | 11 | 8 | Inventive Example |
| 10 | 0.095 | 0.073 | 0.064 | 0.131 | 35 | 21 | 16 | Inventive Example |
| 11 | 0.090 | 0.068 | 0.062 | 0.119 | 50 or more | 33 | 22 | Inventive Example Inventive Example |
| 12 | 0.082 | 0.063 | 0.057 | 0.112 | 50 or more | 41 | 32 | Inventive Example |
| 13 | 0.123 | 0.080 | 0.073 | 0.161 | 5 | 3 | 3 | Comparative Example |
| 14 | 0.103 | 0.070 | 0.069 | 0.133 | 22 | 12 | 9 | Inventive Example |
| 15 | 0.092 | 0.072 | 0.066 | 0.119 | 38 | 22 | 14 | Inventive Example |
| 16 | 0.078 | 0.069 | 0.061 | 0.112 | 50 or more | 31 | 25 | Inventive Example |
| 17 | 0.083 | 0.094 | 0.058 | 0.101 | 50 or more | 42 | 34 | Inventive Example |
| 18 | 0.122 | 0.098 | 0.078 | 0.155 | 6 | 4 | 3 | Comparative Example |
| 19 | 0.102 | 0.073 | 0.067 | 0.129 | 19 | 12 | 9 | Inventive Example |
| 20 | 0.090 | 0.071 | 0.063 | 0.121 | 40 | 20 | 16 | Inventive Example |
| 21 | 0.079 | 0.070 | 0.059 | 0.113 | 50 or more | 31 | 20 | Inventive Example |
| 22 | 0.080 | 0.066 | 0.057 | 0.099 | 50 or more | 42 | 33 | Inventive Example |
| 23 | 0.119 | 0.090 | 0.072 | 0.158 | 7 | 5 | 3 | Comparative Example |
| 24 | 0.103 | 0.073 | 0.070 | 0.132 | 19 | 11 | 8 | Inventive Example |
| 25 | 0.089 | 0.070 | 0.065 | 0.123 | 39 | 23 | 16 | Inventive Example |
| 26 | 0.085 | 0.069 | 0.060 | 0.111 | 50 or more | 33 | 22 | Inventive Example |
| 27 | 0.075 | 0.064 | 0.059 | 0.103 | 50 or more | 41 | 32 | Inventive Example |
| 28 | 0.125 | 0.078 | 0.079 | 0.155 | 6 | 3 | 3 | Comparative Example |
| 29 | 0.101 | 0.074 | 0.068 | 0.141 | 21 | 10 | 7 | Inventive Example |
| 30 | 0.095 | 0.072 | 0.061 | 0.119 | 33 | 25 | 19 | Inventive Example |
| 31 | 0.083 | 0.070 | 0.061 | 0.112 | 50 or more | 33 | 21 | Inventive Example |
| 32 | 0.078 | 0.064 | 0.060 | 0.105 | 50 or more | 43 | 30 | Inventive Example |
| 33 | 0.122 | 0.081 | 0.080 | 0.162 | 5 | 4 | 3 | Comparative Example |
| 34 | 0.108 | 0.075 | 0.064 | 0.130 | 23 | 12 | 9 | Inventive Example |
| 35 | 0.097 | 0.072 | 0.062 | 0.118 | 36 | 20 | 16 | Inventive Example |
| 36 | 0.082 | 0.070 | 0.060 | 0.113 | 50 or more | 34 | 20 | Inventive Example |
| 37 | 0.079 | 0.065 | 0.057 | 0.095 | 50 or more | 42 | 32 | Inventive Example |
| 38 | 0.130 | 0.080 | 0.076 | 0.160 | 6 | 4 | 3 | Comparative Example |
| 39 | 0.102 | 0.076 | 0.066 | 0.125 | 21 | 13 | 8 | Inventive Example |
| 40 | 0.082 | 0.072 | 0.064 | 0.118 | 30 | 21 | 16 | Inventive Example |
| 41 | 0.081 | 0.071 | 0.059 | 0.110 | 50 or more | 32 | 24 | Inventive Example |
| 42 | 0.078 | 0.070 | 0.056 | 0.096 | 50 or more | 44 | 31 | Inventive Example |
| 43 | 0.125 | 0.083 | 0.077 | 0.158 | 5 | 3 | 3 | Comparative Example |
| 44 | 0.100 | 0.072 | 0.068 | 0.128 | 20 | 10 | 7 | Inventive Example |
| 45 | 0.081 | 0.071 | 0.062 | 0.117 | 33 | 24 | 18 | Inventive Example |
| 46 | 0.082 | 0.070 | 0.061 | 0.112 | 50 or more | 30 | 22 | Inventive Example |
| 47 | 0.072 | 0.065 | 0.055 | 0.105 | 50 or more | 45 | 33 | Inventive Example |
| 48 | 0.124 | 0.084 | 0.075 | 0.157 | 6 | 3 | 3 | Comparative Example |
| 49 | 0.105 | 0.075 | 0.065 | 0.129 | 19 | 11 | 8 | Inventive Example |
| 50 | 0.093 | 0.072 | 0.061 | 0.120 | 36 | 27 | 19 | Inventive Example |
| 51 | 0.081 | 0.069 | 0.058 | 0.111 | 50 or more | 34 | 21 | Inventive Example |
| 52 | 0.072 | 0.065 | 0.056 | 0.106 | 50 or more | 46 | 30 | Inventive Example |

*1Immeasurable due to occurrence of mold galling

The following has become clear from the test results listed in Table 2. No. 7 is an example in which no crystalline layered material is adhered to the surface layer and a comparative example with respect to the present invention. This comparative example has high kinetic friction coefficients and inferior mold galling resistances. Nos. 8, 13, 18, 23, 28, 33, 38, 43, and 48 have the crystalline layered materials applied on the surface layers, but their average film thicknesses are out of the scope of the present invention, and they are comparative examples with respect to the present invention. These comparative examples have lower kinetic friction coefficients than No. 7 and improved mold galling resistances, but not sufficiently. Nos. 9 to 12, 14 to 17, 19 to 22, 24 to 27, 29 to 32, 34 to 37, 39 to 42, 44 to 47, and 49 to 52 have the crystalline layered materials applied on the surface layers, their average film thicknesses are within the scope of the present invention, and they are examples of the present invention. These inventive examples have lower kinetic friction coefficients and better mold galling resistances as compared to the above-described comparative examples.

The cold rolled steel sheet of the present invention is excellent in press formability; and therefore applicable in wideranging fields with a focus on uses in automotive bodies requiring difficult-to-form materials.

REFERENCE SIGNS LIST

1 Friction coefficient measuring specimen
2 Specimen stand
3 Slide table
4 Rollers
5 Slide table support
6 Bead
7 First load cell
8 Second load cell
9 Rail
N Pressing load
F Sliding resistance force

The invention claimed is:

1. A cold rolled steel sheet comprising an inorganic film containing a crystalline layered material on a surface thereof, wherein the inorganic film has an average film thickness of 10 nm to 2000 nm, wherein the crystalline layered material is a layered double hydroxide represented by $[M^{2+}_{1-X}M^{3+}_{X}(OH)_2][A^{n-}]_{x/n}.zH_2O$, wherein:

$M^{2+}$ is one or more of $Ca^{2+}$, $Zn^{2+}$, $Pb^{2+}$, and $Sn^{2+}$;

$M^{3+}$ is one or more of $Cr^{3+}$, $3/4Zr^{4+}$, and $Mo^{3+}$; and $A^{n-}$ is one or more of $F^-$, $Cl^-$, $Br^-$, $(C_2O_4)^{2-}$, $I^-$, $(NO_3)^-$, $(SO_4)^{2-}$, $(BrO_3)^-$, $(IO_3)^-$, $(V_{10}O_{28})^{6-}$, $(Si_2O_5)^{2-}$, $(ClO_4)^-$, $(CH_3COO)^-$, $[C_6H_4(CO_2)_2]^{2-}$, $(C_6H_5COO)^-$, $[C_8H_{16}(CO_2)_2]^{2-}$, $n(C_8H_{17}SO_4)^-$, $n(C_{12}H_{25}SO_4)^-$, $n(C_{18}H_{37}SO_4)^-$, and $SiO_4^{4-}$, and wherein $0<x\leq0.33$, $1\leq n\leq2$, and $0.33\leq z\leq1$.

2. A cold rolled steel sheet comprising an inorganic film containing a crystalline layered material on a surface thereof, wherein the inorganic film has an average film thickness of 10 nm to 2000 nm, wherein the crystalline layered material is a layered double hydroxide represented by $[M^{2+}_{1-X}M^{3+}_{X}(OH)_2][A^{n-}]_{x/n}.zH_2O$, wherein:

$M^{2+}$ is one or more of $Ca^{2+}$ and $Zn^{2+}$;

$M^{3+}$ is $Cr^{3+}$; and $A^{n-}$ is one or more of $Cl^-$ and $(SO_4)^{2-}$, and wherein $0<x\leq0.33$, $15\leq n\leq2$, and $0.33\leq z\leq1$.

* * * * *